US007824349B2

(12) United States Patent
Lv

(10) Patent No.: US 7,824,349 B2
(45) Date of Patent: Nov. 2, 2010

(54) MASSAGE CHAIR HAVING CONCEALABLE LEG MASSAGE UNIT

(75) Inventor: Shu Lv, Suzhou (CN)

(73) Assignee: Daito-Osim Healthcare Appliance (Suzhou) Co., Ltd., Suzhou (CN)

( * ) Notice: Subject to any disclaimer, the term of this patent is extended or adjusted under 35 U.S.C. 154(b) by 1212 days.

(21) Appl. No.: 11/399,652

(22) Filed: Apr. 7, 2006

(65) Prior Publication Data

US 2007/0060850 A1 Mar. 15, 2007

(30) Foreign Application Priority Data

Sep. 9, 2005 (CN) ..... 2005 1 0094315

(51) Int. Cl.
*A61H 7/00* (2006.01)
*A47C 7/50* (2006.01)
*A47C 20/04* (2006.01)

(52) U.S. Cl. ..... 601/98; 601/133; 297/423.21; 297/423.22; 297/423.28

(58) Field of Classification Search ..... 601/49, 601/24, 86, 90, 93, 98, 101, 104, 115, 116, 601/133, 134; 297/423.2, 423.21, 423.28, 297/423.22
See application file for complete search history.

(56) References Cited

U.S. PATENT DOCUMENTS

2005/0124922 A1* 6/2005 Lin ..... 601/115

FOREIGN PATENT DOCUMENTS

| | | | |
|---|---|---|---|
| CN | 2537288 Y | | 2/2003 |
| JP | 11-19149 A | | 1/1999 |
| JP | 2003062024 A | * | 3/2003 |

* cited by examiner

*Primary Examiner*—Danton DeMille
(74) *Attorney, Agent, or Firm*—Perkins Coie LLP; Michael Wise

(57) ABSTRACT

The present invention reveals a massage chair having concealable leg massage unit, including a massage chair and a leg massage unit positioned in a front portion of the massage chair. The two sides of the massage chair are provided with guiding tracks respectively and a moving means which moves along the guiding tracks. The rear portions of the guiding tracks are horizontal, and the front portions arc upward. The moving means is fixed with forward extended push-pull rods with a front end of each push-pull rod pivotally connected to a rear end of a tow board. A front end of the tow board is provided with a rolling wheel, and the leg massage unit is pivotally connected between two tow boards. The present invention not only reduces the volume of a massage chair but also makes itself more convenient and comfortable to users.

7 Claims, 5 Drawing Sheets

MASSAGE CHAIR HAVING CONCEALABLE LEG MASSAGE UNIT

CROSS-REFERENCE TO RELATED APPLICATION

The subject application claims priority on application no. 200510094315.8 filed Sep. 9, 2005 in China, the subject matter of the Chinese priority application is incorporated herewith by reference.

FIELD OF THE INVENTION

The present invention relates to a massage chair having concealable leg massage unit.

BACKGROUND OF THE INVENTION

In the existing art, a massage chair is not only able to massage the back and the hip of a user but also able to massage the legs of a user. The leg massage unit is usually positioned in front of a massage chair with elevation adjustable to meet satisfaction of a user. However, the existence of the leg massage unit greatly increases the volume of a massage chair. In addition, when a user is doing back massage or hip massage, the existence of the leg massage unit may influence the effect of massage.

BRIEF SUMMERY OF THE INVENTION

The object of the present invention is to provide a massage chair having concealable leg massage unit, the leg massage unit of which can be concealed in an inner side of the massage chair, thus reduces the volume of a massage chair and makes itself more convenient and comfortable to the users.

In one technical solution of the present invention, it is provided with a massage chair having concealable leg massage unit including a massage chair, a leg massage unit positioned in a front portion of the massage chair and a push-pull means connected to the leg massage unit to allow movement of the leg massage unit from an extended position to a retracted position. When the push-pull means is pulled out, the leg massage unit is in the extended position where the massage chair having concealable leg massage unit is in operation; and when the push-pull means is pushed in, the leg massage unit is in the retracted position where the leg massage unit is concealed.

In a detailed technical solution of the present invention, it is provided with a massage chair having concealable leg massage unit including a massage chair, a leg massage unit positioned in a front portion of the massage chair and a push-pull means connected to the leg massage unit to allow movement of the leg massage unit from an extended position to a retracted position. When the push-pull means is pulled out, the leg massage unit is in the extended position where the massage chair having concealable leg massage unit is in operation; and when the push-pull means is pushed in, the leg massage unit is in the retracted position where the leg massage unit is concealed. The push-pull means comprises at least two guiding tracks located in two opposed sides of the massage chair; a moving means which is able to move along the guiding tracks; and each supporting frame including a forward extended push-pull rod fixed on the opposed ends of the moving means and a tow board, a front end of the tow board connected to a rolling wheel and a rear end of the tow board pivotally connected to a front end of the push-pull rod. The leg massage unit is positioned between the two said tow boards of the supporting frames.

In a further detailed technical solution of the present invention, it is provided with a massage chair having concealable leg massage unit including a massage chair, a leg massage unit positioned in a front portion of the massage chair and a push-pull means connected to the leg massage unit to allow movement of the leg massage unit from an extended position to a retracted position. When the push-pull means is pulled out, the leg massage unit is in the extended position where the massage chair having concealable leg massage unit is in operation; and when the push-pull means is pushed in, the leg massage unit is in the retracted position where the leg massage unit is concealed. The push-pull means comprises at least two guiding tracks located in two opposed sides of the massage chair; a moving means which is able to move along the guiding tracks; and each supporting frame including a forward extended push-pull rod fixed on the opposed ends of the moving means and a tow board, a front end of the tow board connected to a rolling wheel and a rear end of the tow board pivotally connected to a front end of the push-pull rod. The leg massage unit is positioned between the two said tow boards of the supporting frames. The moving means further comprises a pair of moving shafts in parallel, and the moving shafts are provided with a driving means, and two ends of the moving tracks are provided with gears, said gears located in the guiding tracks and in mesh with a rack fixed in a side of each guiding track, and the pair of push-pull rods are fixed on the moving shafts located in an inner side of the gears, respectively. A rear portion of the guiding tracks is horizontal and a front portion of the guiding track arcs upward. The tow boards are generally triangular and the leg massage means is pivotally connected to an upper end of the tow boards. Said rack is fixed on an upper end of the guiding track, and a lower side of the guiding tracks is a step, an upper end of said step supporting the moving shaft, keeping the gears in mesh with the racks. When the moving means is positioned in a horizontal part of the guiding track, the forward extended push-pull rod inclines slightly downward, with a connection point of the push-pull rods and the tow boards higher than the ground. Said driving means including a decelerator fixed on the two moving shafts and a motor. The guiding tracks are provided on two side boards, said side boards fixed in an inner side of armrests of the massage chair.

The advantages of the present invention are as follows:

1. The leg massage unit of the present invention can be concealed in an inner side of the massage chair, thus reduces the volume of a massage chair and makes itself more convenient and comfortable to the users.
2. The leg massage unit of the present invention is pivotally connected between the two tow boards, and each tow board driven by a push-pull rod has a rolling wheel at one end in contact with the ground, and the push-pull rods are further driven by moving means which moves along the guiding track. When the moving means moves to a warped part of the guiding tracks, the push-pull rods move upward and correspondingly bring up the tow boards, making the leg massage unit inclined in front of the massage chair for users to do leg massage. And when the moving means moves to a horizontal part in the rear portion of the guiding tracks, the push-pull rods extend forward and slightly downward, making the leg massage unit move backwards to inside the seat of the massage chair.

BRIEF DESCRIPTION OF THE DRAWINGS

The present invention will be further described below in conjunction with the drawings and the embodiments.

Figure 1:
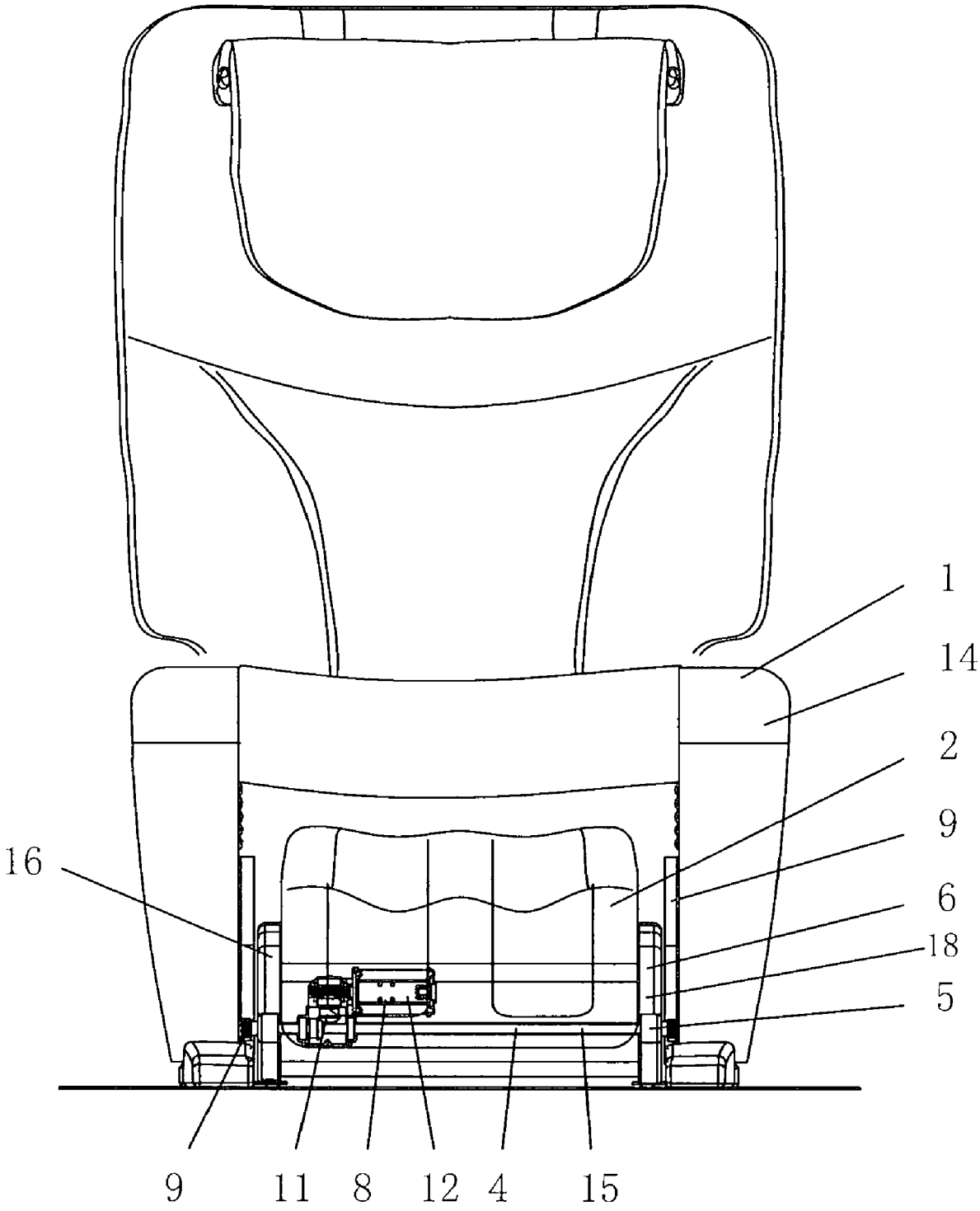
FIG. 1 is a front plan view of the present invention.
Figure 2:
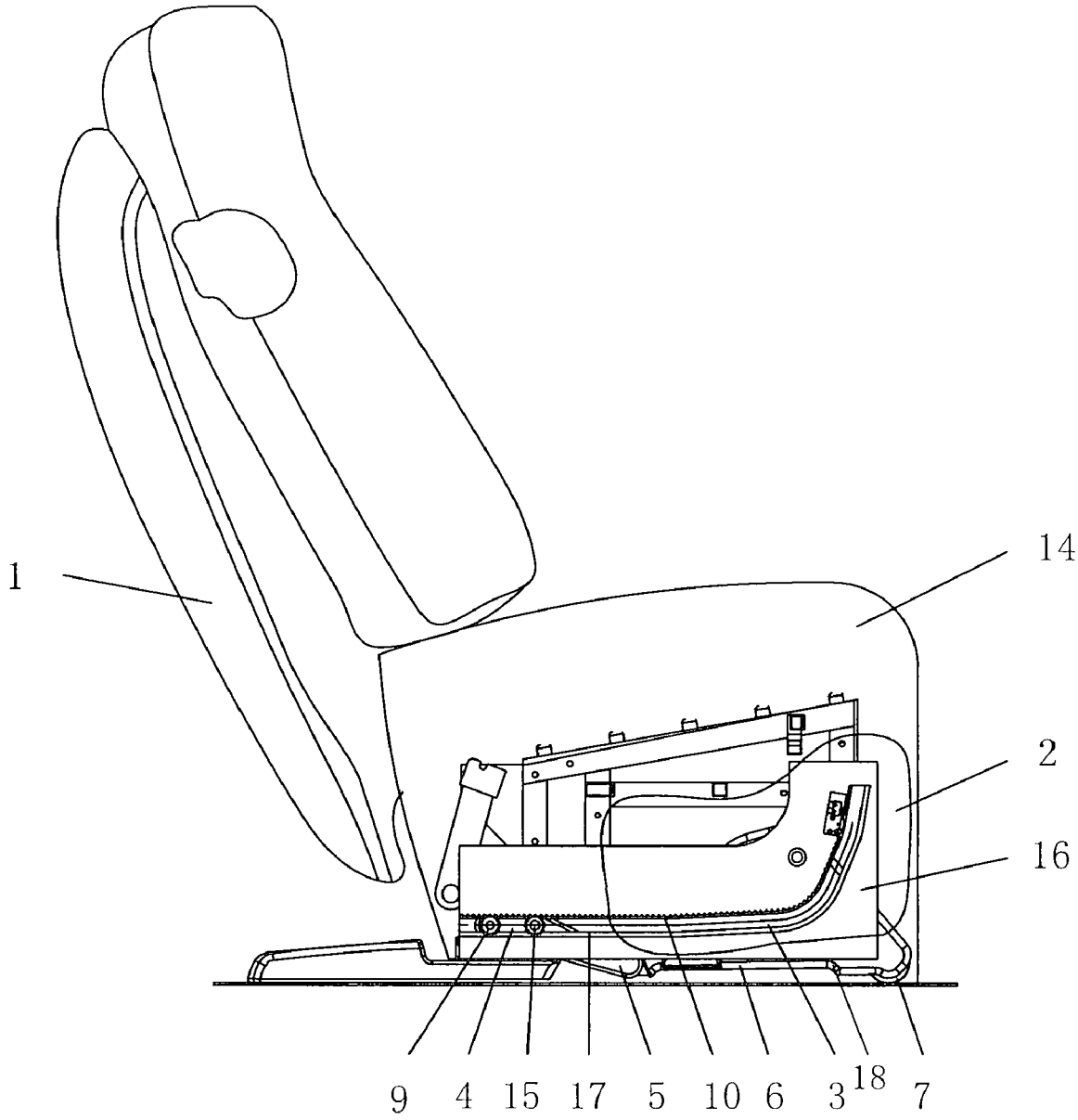
FIG. 2 is a side plan view of the present invention.

In the drawings: 1 massage chair; 2 leg massage unit; 3 guiding track; 4 moving means; 5 push-pull rod; 6 tow board; 7 rolling wheel; 8 driving means; 9 gear; 10 rack; 11 decelerator; 12 motor; 13 side board; 14 armrest; 15 moving shaft; 16 push-pull means; 17 step; 18 supporting frames.

DESCRIPTION OF THE PREFERRED EMBODIMENTS

Referring to all the figures, a massage chair having concealable leg massage unit including a massage chair 1 and a leg massage unit 2 positioned in a front portion of the massage chair 1. The massage chair 1 further comprises a push-pull means 16 connected to the leg massage unit 2. The push-pull means 16 comprises a pair of side boards 13 provided in inner sides of the two armrests 14 of the massage chair 1 respectively. The side boards 13 are provided with guiding tracks 3 and a moving means 4 which moves along the guiding tracks 3. A rear portion of the respective one of the guiding tracks 3 is horizontal and the front portion arcs upward.

The moving means 4 includes two moving shafts 15 in parallel. The two moving shafts 15 are provided with a driving means consisted of a decelerator 11 and a motor 12. The two ends of each moving shaft 15 are fixed with gears 9, each gear 9 located in the guiding tracks 3 respectively and in mesh with a rack 10 fixed in an upper side of each guiding track 3. A lower side of the guiding tracks 3 is a step 17, an upper end of which supports the moving shafts 15, keeping the gears 9 in mesh with the racks 10. A forward extended push-pull rod 5 is fixed on the moving shafts 15 positioned in an inner side of the gears 9 respectively, with a front end pivotally connected to a rear end of each of the generally triangular-shaped tow boards 6. A front portion of each of the tow boards 6 is provided with a rolling wheel 7. When the leg massage unit 2 is pivotally connected between the two tow boards 6, the connection point is at a higher end of the tow boards 6. When the moving shafts 15 are positioned in a horizontal part of the guiding tracks 3, the forward extended push-pull rod 5 inclines slightly downward, with a connection point higher than the ground.

Figure 3:
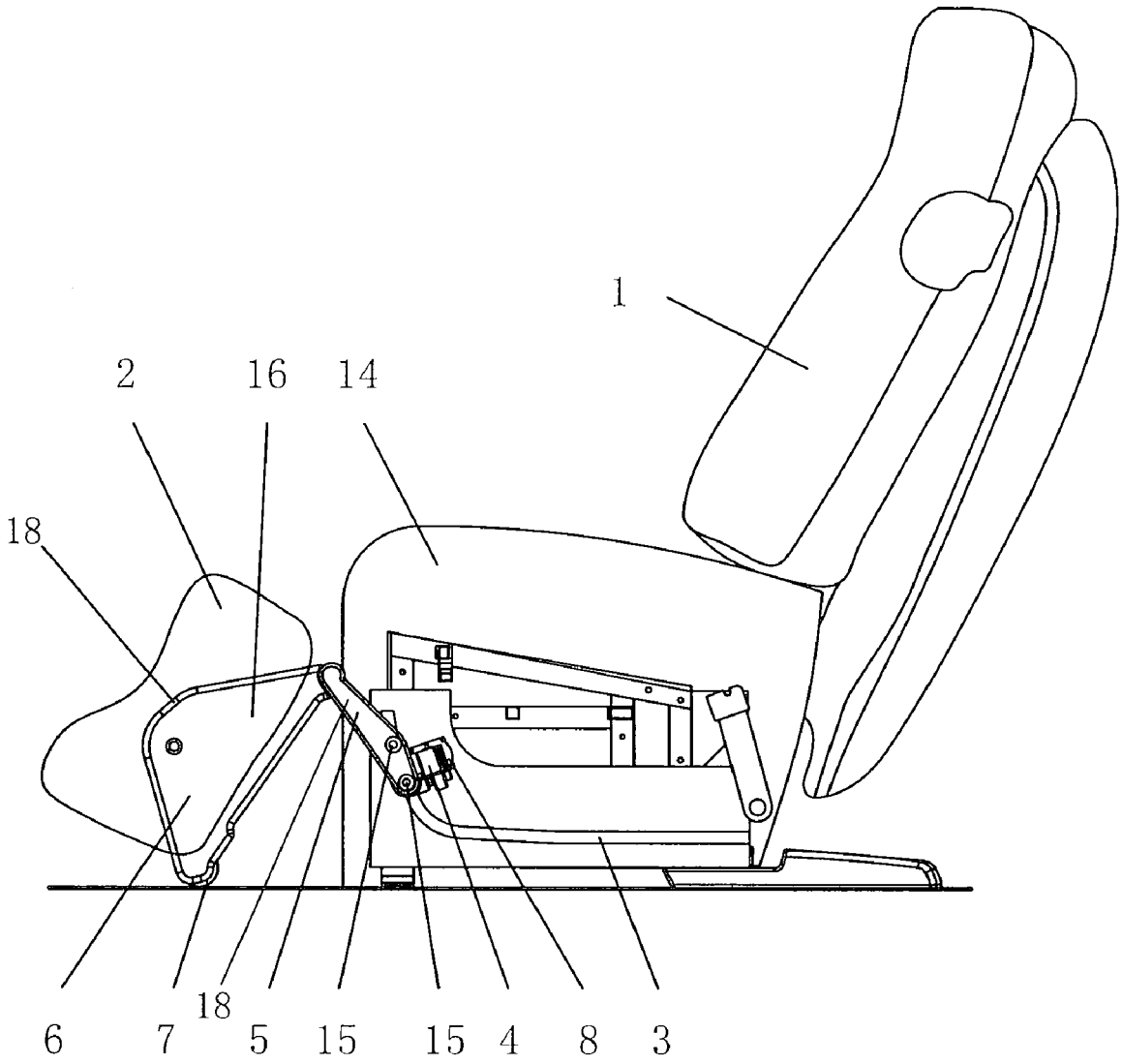
FIG. 3 is a schematic view of the present invention showing the using status of the present invention.
Figure 4:
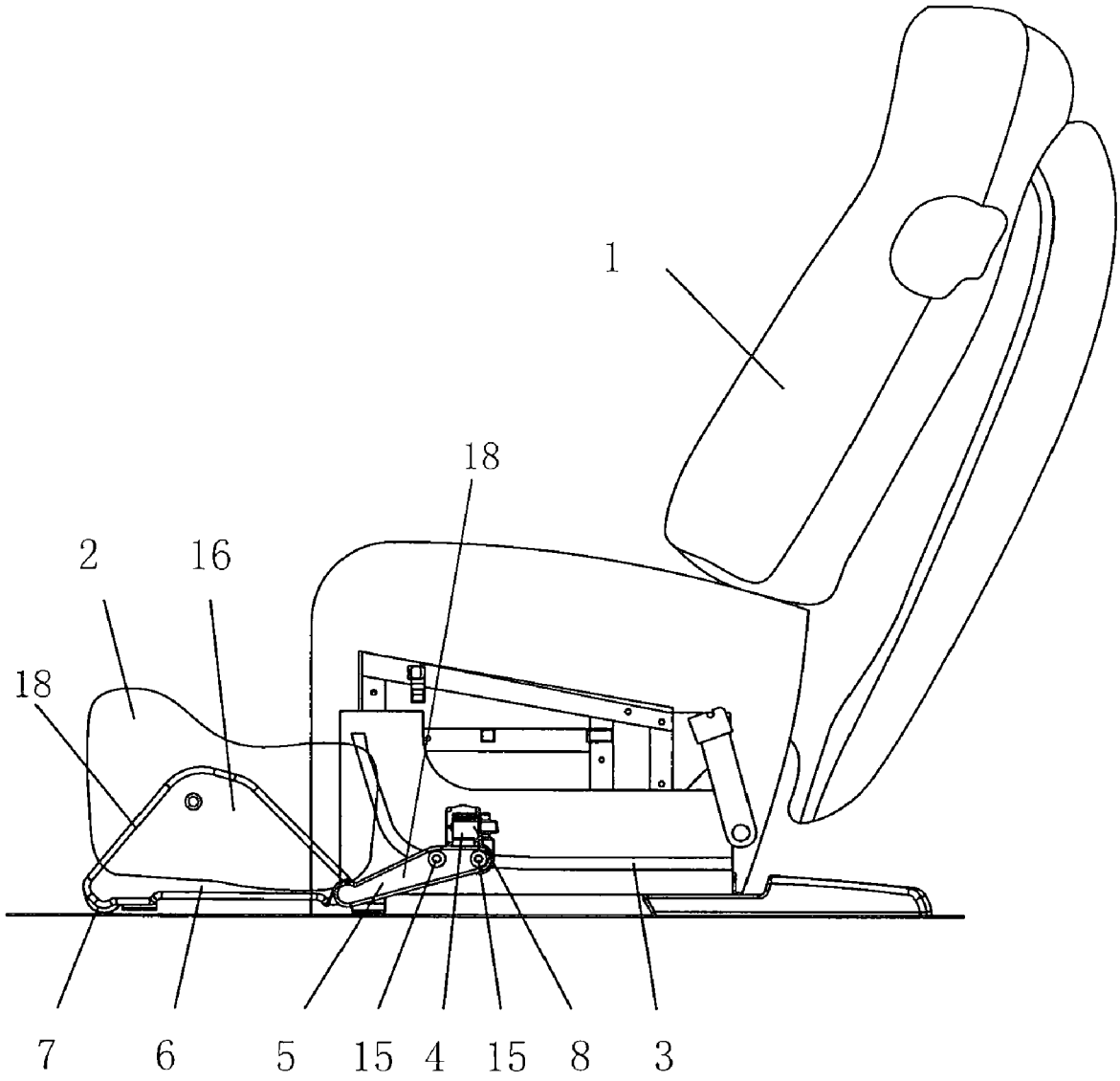
FIG. 4 is a schematic view of the present invention showing the moving status of the present invention.
Figure 5:
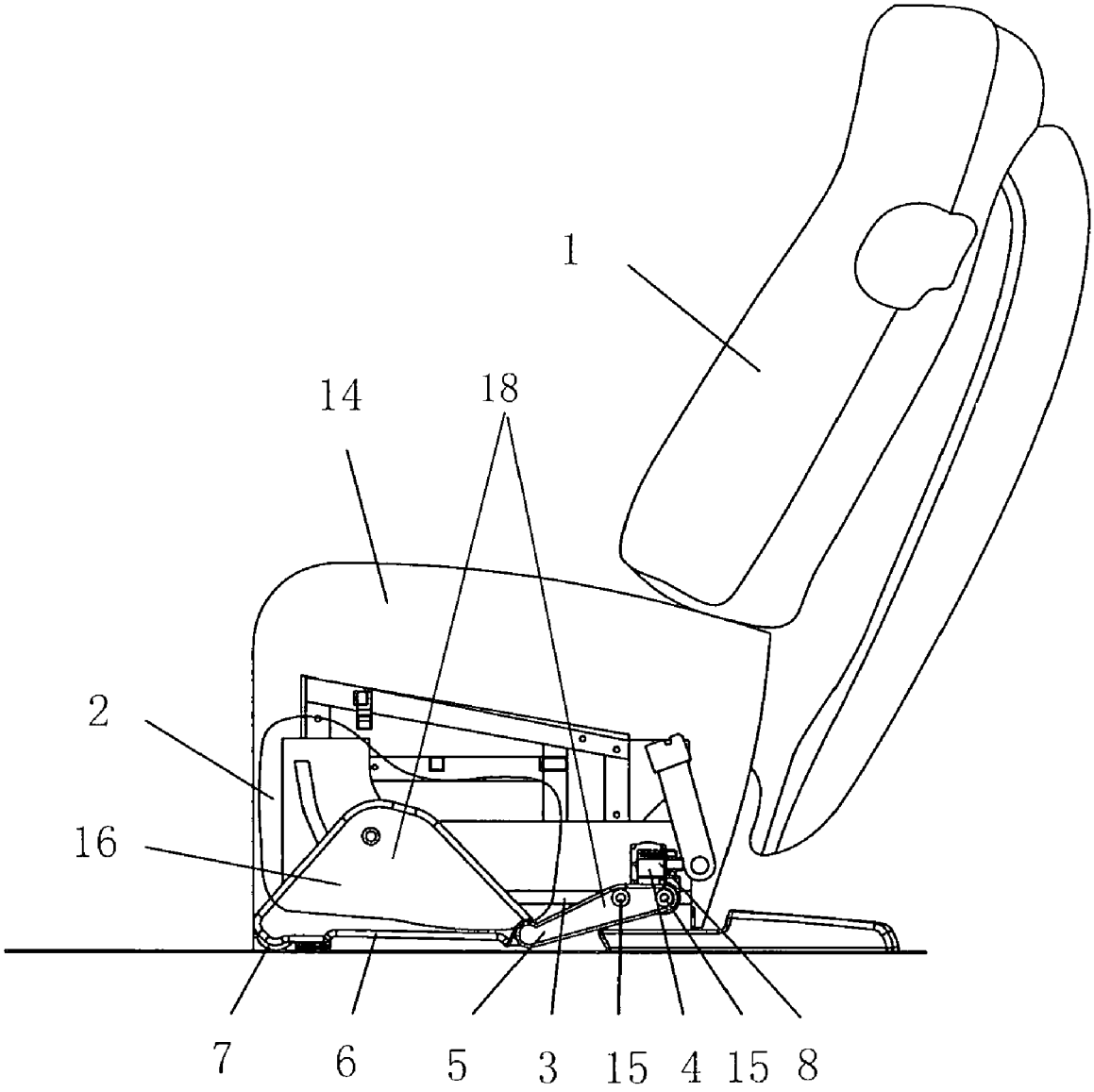
FIG. 5 is a schematic view of the present invention showing the concealing status of the present invention.

Referring to FIG. 3, FIG. 4 and FIG. 5, when a user presses a "on" button, for example, the moving shafts 15 are driven by the motor 13, the decelerator 12, the gears 9 and the racks 10 and move forward along the guiding tracks 3. Thereby the push-pull rods 5 and the tow boards 6 push out the leg massage unit 2 located inside the massage chair 1. And when the moving shafts 15 move to the warped part of the guiding track 3, the push-pull rods 5 will bring up the rear end of the tow boards 6, making the whole leg massage unit 2 inclined in front of the massage chair 1, thereby the user may put his or her legs in the lag massage unit 2 and have a massage.

When a user does not want to have massage any more, he or she may press the "on" button again, for example, making the moving shafts 15 to move backwards. When the moving shafts 15 move backwards, the push-pull rods 5 will bring down the rear end of the tow boards 6 at first, and then the leg massage unit 2 moves along the horizontal part of the guiding tracks 3, thereby the leg massage unit 2 is concealed inside the massage chair 1.

The present invention not only reduces the volume of a massage chair but also makes itself more convenient and comfortable to users.

The invention claimed is:

1. A massage chair having a concealable leg massage unit comprising:

a massage chair, a leg massage unit positioned in a front portion of the massage chair, and a push-pull means connected to the leg massage unit to allow movement of the leg massage unit from an extended position to a retracted position, the push-pull means comprising at least two guiding tracks located at two opposed sides of the massage chair, a moving means which is able to move along the two guiding tracks, and supporting frames on the opposed sides of the massage chair comprising two forward extended push-pull rods fixed on the opposite ends of the moving means and two tow boards pivotally connected on both sides of the leg massage unit to allow the leg massage unit rotate pivotally, respectively, the rear end of each of the two tow boards pivotally connected to the front end of each of the two push-pull rods respectively, and the front end of each tow board being provided with a rolling wheel, wherein when the push-pull means is pulled out, the leg massage unit is in the extended position where the massage chair having concealable leg massage unit is in operation; and wherein when the push-pull means is pushed in, the leg massage unit is in the retracted position where the leg massage unit is concealed, wherein the moving means further comprises at least two moving shafts in parallel, and the moving shafts are provided with a driving means, and two ends of each moving shaft are provided with gears, the gears located in each guiding track and in mesh with a rack fixed in a side portion of each guiding track, and the push-pull rods are fixed on the moving shafts located in an inner side of the gears, respectively.

2. The massage chair having concealable leg massage unit according to claim 1, wherein a rear portion of each of the guiding track is horizontal and a front portion of each of the guiding track arcs upward.

3. The massage chair having concealable leg massage unit according to claim 1, wherein the tow boards are generally triangular and the leg massage means is pivotally connected to the two upper ends of the two tow boards respectively.

4. The massage chair having concealable leg massage unit according to claim 1, wherein the rack is fixed on an upper end of the guiding track, and a lower side of the guiding tracks is a step, an upper end of the step supporting the moving shafts, keeping the gears in mesh with the racks.

5. The massage chair having concealable leg massage unit according to claim 1, wherein when the moving means is positioned in a horizontal part of the guiding track, the forward extended push-pull rod inclines slightly downward, with a connection point of the push-pull rods and the tow boards higher than the ground.

6. The massage chair having concealable leg massage unit according to claim 1, wherein the guiding tracks are provided on two side boards, the side boards fixed in inner sides of armrests of the massage chair.

7. The massage chair having concealable leg massage unit according to claim 1, wherein the driving means including a decelerator fixed on the two moving shafts and a motor.

* * * * *